US008083040B2

(12) United States Patent
Chiang

(10) Patent No.: US 8,083,040 B2
(45) Date of Patent: Dec. 27, 2011

(54) ZIPPER FOR LUGGAGE AND LUGGAGE USING THE SAME

(75) Inventor: Hsi-Wu Chiang, Taichung County (TW)

(73) Assignee: C&C Luggage Manufacturing Co., Ltd., Taiping, Taichung County (TW)

( * ) Notice: Subject to any disclaimer, the term of this patent is extended or adjusted under 35 U.S.C. 154(b) by 126 days.

(21) Appl. No.: 12/757,454

(22) Filed: Apr. 9, 2010

(65) Prior Publication Data

US 2011/0198175 A1 Aug. 18, 2011

(51) Int. Cl.
*A45C 13/10* (2006.01)
*A44B 19/02* (2006.01)
*A44B 19/36* (2006.01)

(52) U.S. Cl. ..... 190/119; 190/121; 190/903; 383/97; 24/381; 24/436

(58) Field of Classification Search ..... 190/28, 190/103, 119, 121, 124, 126, 903; 206/810; 383/97; 24/381, 382, 436, 585.1
See application file for complete search history.

(56) References Cited

U.S. PATENT DOCUMENTS 2,438,780 A * 3/1948 Hochner ..... 190/119
2,756,172 A * 7/1956 Kidd ..... 138/147
3,266,604 A * 8/1966 Kish, Jr. ..... 190/113
3,443,671 A * 5/1969 Dyke ..... 190/103
3,477,553 A * 11/1969 Kish, Jr. ..... 190/119
3,993,725 A * 11/1976 Brown ..... 264/145
5,111,919 A * 5/1992 Hamatani et al. ..... 190/109
5,386,616 A * 2/1995 Norvell ..... 24/389
6,345,709 B1 * 2/2002 Cheng ..... 190/119
6,722,520 B2 * 4/2004 Hupp et al. ..... 220/315
6,877,192 B2 * 4/2005 Tominaga et al. ..... 24/381
7,143,878 B2 * 12/2006 Selvi ..... 190/103
7,641,030 B2 * 1/2010 Selvi ..... 190/40

FOREIGN PATENT DOCUMENTS

GB 2196691 A * 5/1988

* cited by examiner

*Primary Examiner* — Sue Weaver
(74) *Attorney, Agent, or Firm* — Muncy, Geissler, Olds & Lowe, PLLC

(57) ABSTRACT

A zipper for a luggage includes a first tape, a second tape and interlockable teeth. The first tape has a shielding section for covering an end edge of a first half shell of the luggage, and a mounting section and an extension section connected with the shielding section respectively. The second tape has a shielding section for covering an end edge of a second half shell of the luggage, and a mounting section and an extension section connected with the shielding section of the second tape respectively. The teeth are mounted on the extension sections of the first and second tapes in two rows. By means of using the zipper in production of the luggage, the process of making the luggage can be simplified and the zipper can be well aligned with the half shells of the luggage, enhancing the yield rate in production of the luggage.

6 Claims, 4 Drawing Sheets

ZIPPER FOR LUGGAGE AND LUGGAGE USING THE SAME

BACKGROUND OF THE INVENTION

1. Field of the Invention

The present invention relates generally to a zipper, and more specifically to a zipper for use in a luggage, and a luggage using the aforesaid zipper.

2. Description of the Related Art

FIG. 1 shows a perspective view of a luggage using a conventional zipper and FIG. 2 is a sectional view taken along line 2-2 of FIG. 1. As shown in FIGS. 1-2, the luggage 1 mainly comprises a first half shell 2, a second half shell 3, a zipper 4 installed between the first and second half shells 2 and 3 for joining the half shells 2 and 3, and two end strips 5 respectively mounted to the periphery edges of the first and second half shells 2 and 3 and connected with two fabric tapes 4*a* of the zipper 4 respectively. In addition to the fabric tapes 4*a*, the zipper 4 further includes a plurality of interlockable teeth 4*b* mounted on the two fabric tapes 4*a* in two rows and a slider 4*c* reciprocally moveable along the path defined by the two rows of the teeth 4*b*. By means of the engagement or disengagement of the interlockable teeth 4*b* of the zipper 4, the first and second half shells 2 and 3 can joined together or separated from each other. The end strips 5 are used to cover the unprocessed end edges of the first and second half shells 2 and 3 and the stitching line, showing a sense of beauty for the luggage.

In production of the aforesaid conventional luggage, the stitching work is carried out and can be done perfectly only after the three elements, i.e. the fabric tape of the zipper, the end strip and the half shell, are well aligned one to another. However, the correlative positions of the aforesaid three elements can hardly be maintained in a stable manner during the whole stitching work, resulting in that the fabric tape of the zipper may offset away from a predetermined rectilinear path where the tape is supposed to be located, which in turn results in that the slider can not move along the teeth smoothly, lowering the yield rate in production of the luggage. In addition, the fabric tape stitched on the luggage will tend to be torn and then separated from the half shell after a long time of use due to the pull force acting thereon. In light of this, it is desired to provide an improved zipper for use in a luggage.

SUMMARY OF THE INVENTION

The present invention has been accomplished in view of the above-noted circumstances. It is therefore an objective of the present invention to provide a zipper for use in a luggage, which is simple in its construction and has less elements so as to simplify the process of making the luggage.

Another objective of the present invention is to provide a zipper for use in a luggage, which is durable in use.

To attain the above-mentioned objectives, the zipper for a luggage, which is adapted for installation between first and second half shells of the luggage, comprises a first tape made of plastic material, a second tape made of plastic material, and a plurality of interlockable teeth. The first tape has a shielding section for covering an end edge of the first half shell of the luggage, a mounting section connected with the shielding section, and an extension section connected with the shielding section. The second tape has a shielding section for covering an end edge of the second half shell of the luggage, a mounting section connected with the shielding section, and an extension section connected with the shielding section. The interlockable teeth are respectively mounted on the extension sections of the first and second tapes in two rows.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
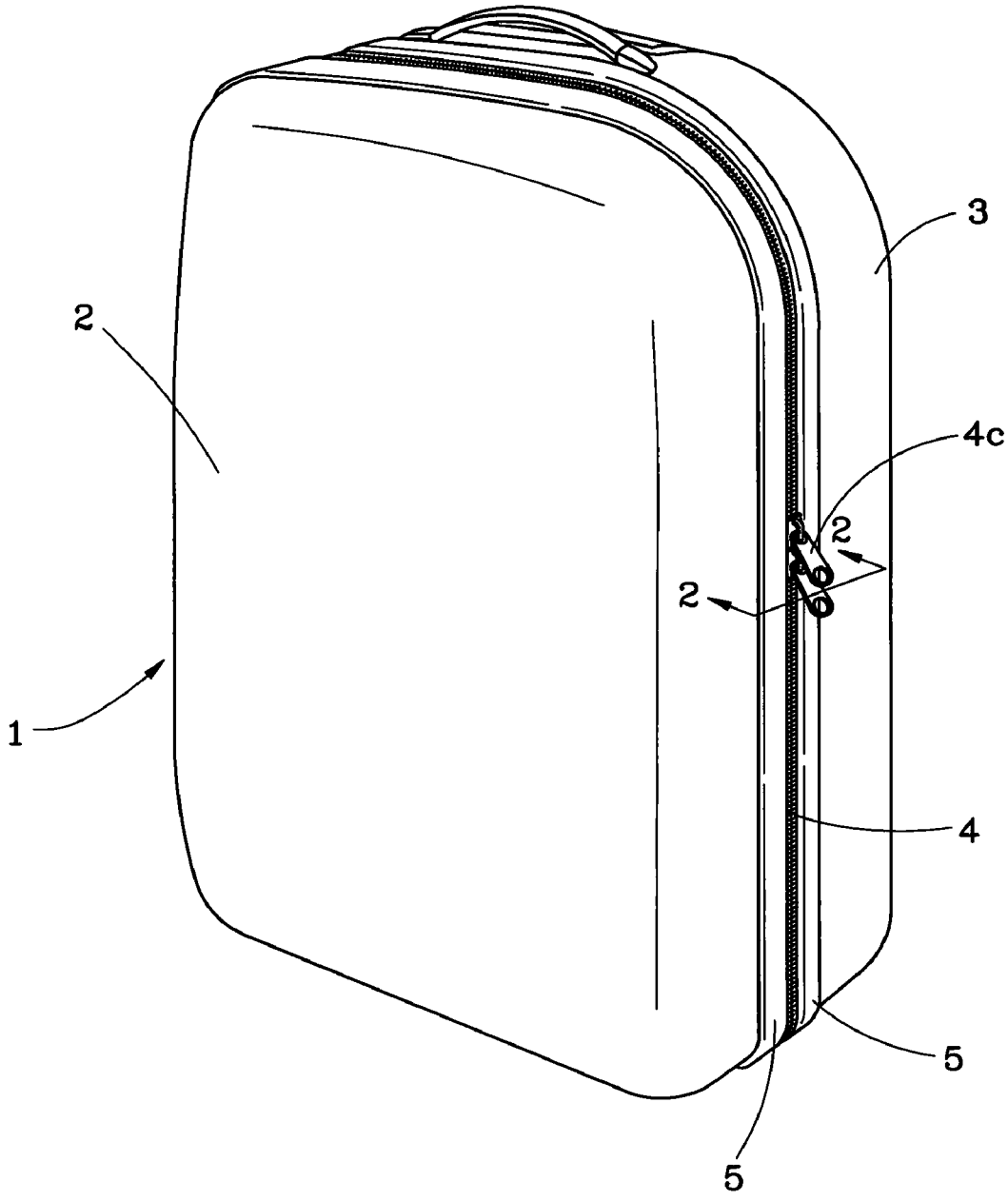
FIG. 1 PRIOR ART
FIG. 1 is a perspective view of a luggage using a conventional zipper.
Figure 2:
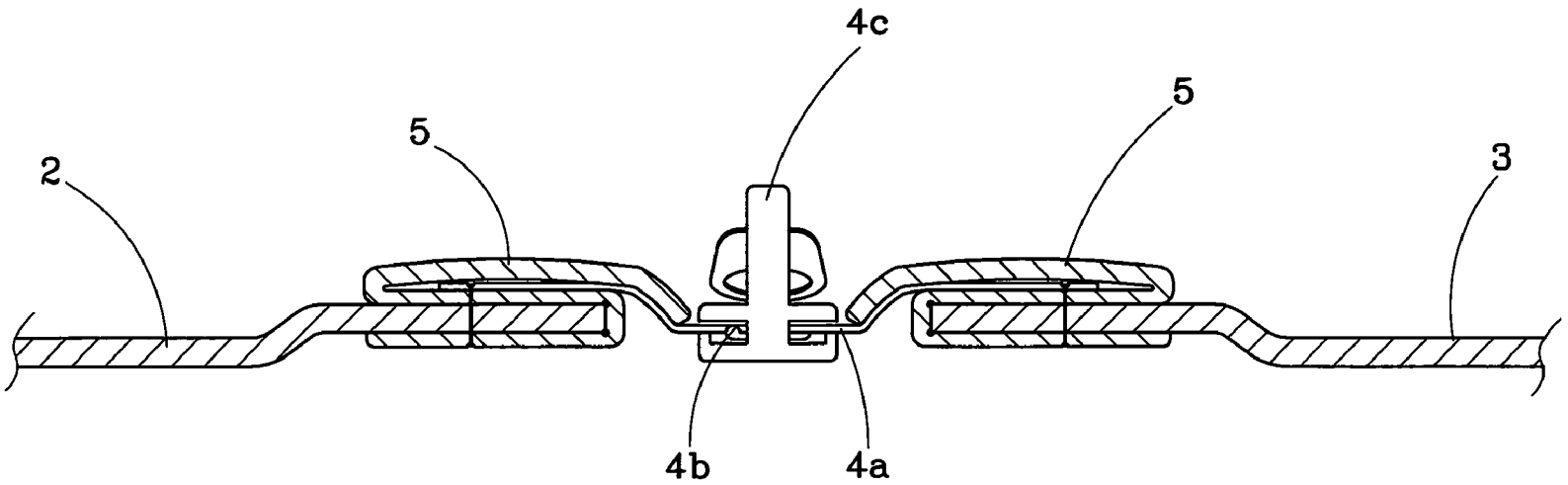
FIG. 2 PRIOR ART
FIG. 2 is a sectional view taken along line 2-2 of FIG. 1.
Figure 3:
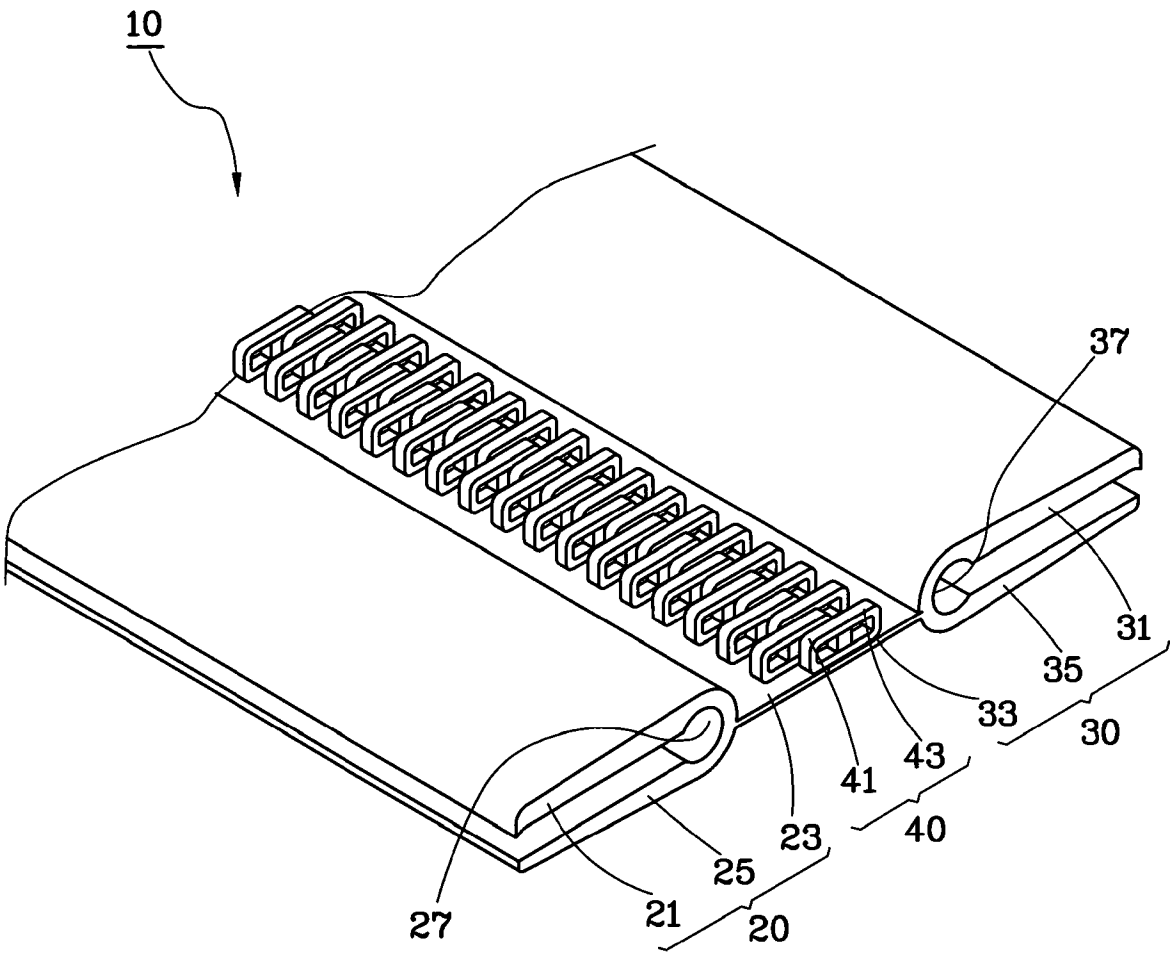
FIG. 3 is a perspective view of a zipper according to a preferred embodiment of the present invention.
Figure 4:
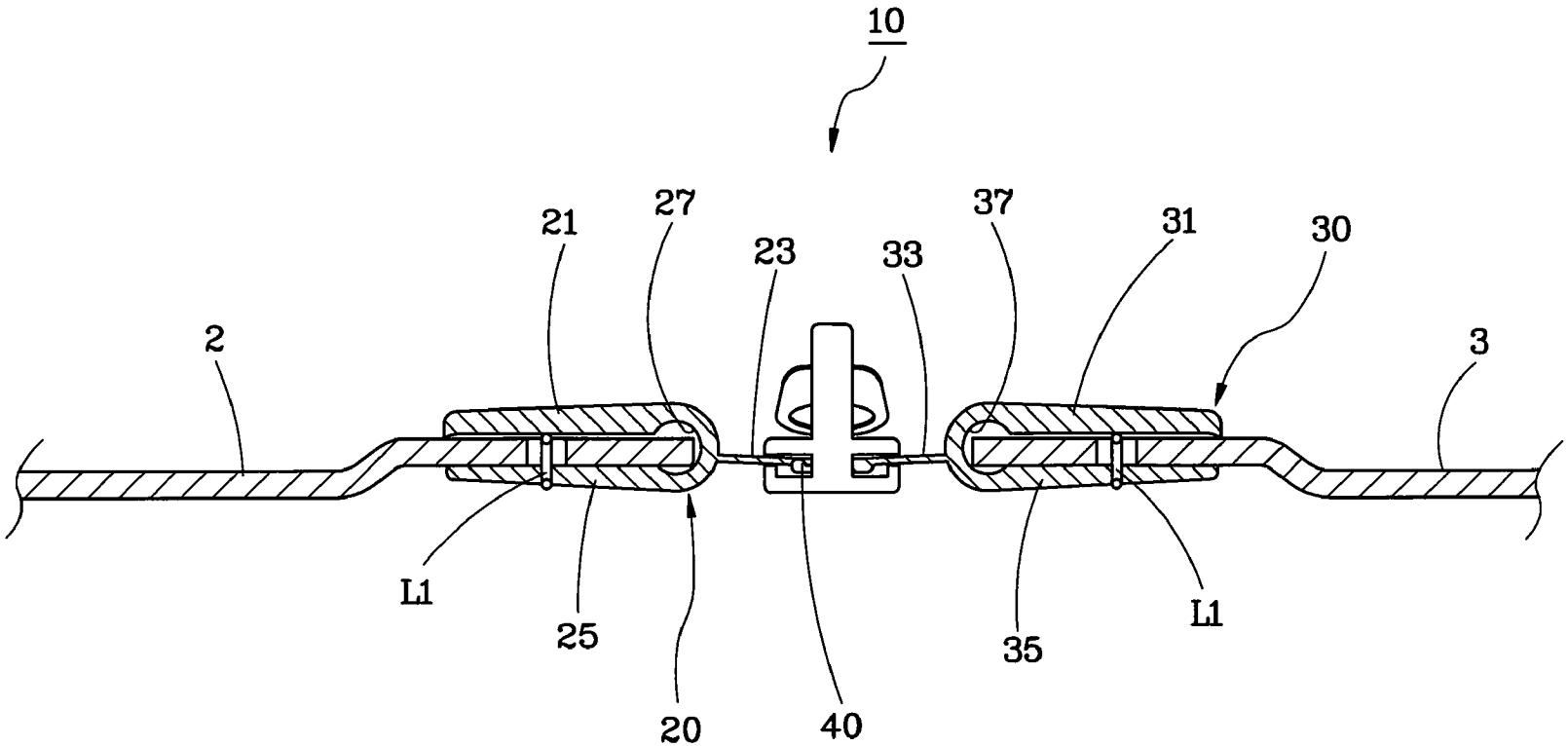
FIG. 4 is a schematic drawing showing the zipper according to the preferred embodiment of the present invention is stitched on a luggage.

As shown in FIGS. 3 and 4, a zipper 10 provided according to a preferred embodiment of the present invention is used to be installed between a first half shell 2 and a second half shell 3. The zipper 10 comprises mainly a first tape 20, a second tape 30 and a plurality of interlockable teeth 40 arranged in two rows.

The first tape 20 is made of plastic material, such as polyvinyl (PVC), polypropylene (PP), polyethylene (PE), polycarbonate (PC), and the like. The first tape 20 has a shielding section 21, an extension section 23 and a mounting section 25, which are all integrally connected. An end of the shielding section 21 and an end of the mounting section 25 are integrally joined so as to jointly define a C-shaped restriction portion 27 therebetween. The extension section 23 extends outwardly from an outer surface of the joint where the shielding section 21 and the mounting section 25 are integrally connected to each other.

The structure and material of the second tape 30 are the same as those of the first tape 20. That is, the second tape 30 also has a shielding section 31, an extension section 33 and a mounting section 35, and a restriction portion 37 is defined at the joint where the shielding section 31 and the mounting section 35 are integrally connected to each other.

The teeth 40 each have an engageable end 41, through which the teeth 40 can be interlocked, and a mounting end 43, which is mounted either on the extension section 23 of the first tape 20 or the extension section 33 of the second tape 30 by stitching or other appropriate way.

As shown in FIG. 4, when the zipper 10 of the present invention is installed in a luggage, the end edge of the first half shell 2 is received between the shielding section 21 and the mounting section 25 of the first tape 20 and stopped at the restriction portion 27, thereby determining precisely the position where the first tape 20 should be mounted to the first half shell 2. After the first tape 20 is aligned with the first half shell 2, the mounting section 25 is sewn on the first half shell 2 by a stitching line L1 in such a way that the stitching line L1 is covered and well protected by the shielding section 21 of the first tape 20. It will be appreciated that the way of fastening the first tape 20 to the first half shell 2 is not limited to aforesaid stitching. For example, adhesive mounting, snap mounting or the like can be used.

Similarly, the second tape 30 can be fastened to the second half shell 3 by the way described in the above paragraph, such that the stitching line L1 for stitching the second tape 30 is also covered and well protected by the shielding section 31 of the second tape 30. As a result, the unprocessed end edges of the first and second half shells 2 and 3 will be respectively hidden between the shielding sections 21 and 31 and the mounting section 25 and 35 of the first and second tapes 20 and 30. In addition, by means of stopping the end edges of the first and second half shells 2 and 3 against the restriction portions 27 and 37 respectively, the first and second tapes 20 and 30 can be precisely aligned with the first and second half shells 2 and 3 respectively and the alignment can be maintained stably during the stitching work.

As indicated above, the zipper provided by the present invention combines the conventional individual end strip and zipper tape into a unit; therefore, the stitching work can be carried out after the alignment of the zipper to the shell of the luggage is simply done. On the other hand, in the process of making the conventional luggage, the stitching work can be carried out only after the conventional zipper, end strip and luggage shell are all aligned one to another. In other words, the zipper of the present invention can effectively minimize the process of assembling the luggage, and the zipper of the present invention can be easily maintained along a rectilinear path upon and after stitching such that the potential problem of unsmooth movement of the slider of the conventional zipper can be prevented so as to enhance the yield rate in production of the luggage. Besides, since the tapes of the zipper of the present invention are made of soft plastic material, the zipper of the present invention will be more durable in use and won't be easily torn upon receiving a pull force under a long time of use.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A zipper for a luggage for installation between first and second half shells of the luggage, the zipper comprising:

a first tape made of plastic material and having a shielding section for covering an end edge of the first half shell of the luggage, a mounting section connected with the shielding section for mounting to the first half shell in a way that the end edge of the first half shell is received between the shielding section and the mounting section, and an extension section connected with the shielding section;

a second tape made of plastic material and having a shielding section for covering an end edge of the second half shell of the luggage, a mounting section connected with the shielding section of the second tape for mounting to the second half shell in a way that the end edge of the second half shell is received between the shielding and the mounting sections of the second tape, and an extension section connected with the shielding section of the second tape; and a plurality of interlockable teeth mounted respectively on the extension sections of the first and second tapes in two rows.

2. The zipper as claimed in claim 1, wherein the first tape has a restriction portion, which is defined at a joint where the shielding and mounting sections of the first tape are connected to each other, for stopping at the end edge of the first half shell of the luggage; the second tape has a restriction portion, which is defined at a joint where the shielding and mounting sections of the second tape are connected to each other, for stopping at the end edge of the second half shell of the luggage.

3. The zipper as claimed in claim 1, wherein the mounting section of the first tape is adapted for being stitched on the first half shell of the luggage by a stitching line in a way that the stitching line is covered by the shielding section of the first tape; wherein the mounting section of the second tape is adapted for being stitched on the second half shell of the luggage by a stitching line in a way that the stitching line is covered by the shielding section of the second tape.

4. A luggage comprising:

a first half shell;

a second haft shell, and a zipper as claimed in claim 1, which is installed between the first and second half shells.

5. The luggage as claimed in claim 4, wherein the first tape has a restriction portion defined at a joint where the shielding and mounting sections of the first tape are connected to each other and stopped at an end edge of the first half shell; the second tape has a restriction portion defined at a joint where the shielding and mounting sections of the second tape are connected to each other and stopped at an end edge of the second shell.

6. The luggage as claimed in claim 4, wherein the mounting section of the first tape is stitched on the first half shell by a stitching line in a way that the stitching line is covered by the shielding section of the first tape; wherein the mounting section of the second tape is stitched on the second half shell by a stitching line in a way that the stitching line is covered by the shielding section of the second tape.

* * * * *